US008491281B2

(12) United States Patent
Hon et al.

(10) Patent No.: US 8,491,281 B2
(45) Date of Patent: Jul. 23, 2013

(54) LONG LIFE SEAL AND ALIGNMENT SYSTEM FOR SMALL CRYOCOOLERS

(75) Inventors: Robert C Hon, Ft. Mitchell, KY (US); Lowell A Bellis, Long Beach, CA (US); Julian A Shrago, Garden Grove, CA (US); Carl S. Kirkconnell, Huntington Beach, CA (US)

(73) Assignee: Raytheon Company, Waltham, MA (US)

( * ) Notice: Subject to any disclaimer, the term of this patent is extended or adjusted under 35 U.S.C. 154(b) by 248 days.

(21) Appl. No.: 12/830,041

(22) Filed: Jul. 2, 2010

(65) Prior Publication Data

US 2012/0000208 A1 Jan. 5, 2012

(51) Int. Cl.
*F04B 43/00* (2006.01)
*F04B 45/00* (2006.01)
*F04B 45/02* (2006.01)

(52) U.S. Cl.
USPC ..... 417/412; 417/472; 62/6

(58) Field of Classification Search
USPC ..... 417/412, 414, 472; 62/6
See application file for complete search history.

(56) References Cited

U.S. PATENT DOCUMENTS

| | | | | |
|---|---|---|---|---|
| 1,789,611 | A * | 1/1931 | Van Ranst | 417/63 |
| 2,797,646 | A * | 7/1957 | Pomykata | 417/412 |
| 2,849,159 | A * | 8/1958 | Kaufmann | 417/472 |
| 3,130,333 | A * | 4/1964 | Freye | 417/412 |
| 5,645,407 | A * | 7/1997 | Kralick et al. | 417/383 |
| 6,167,707 | B1 | 1/2001 | Price et al. | |
| 6,330,800 | B1 * | 12/2001 | Price et al. | 60/520 |
| 6,345,963 | B1 * | 2/2002 | Thomin et al. | 417/412 |
| 7,062,922 | B1 | 6/2006 | Kirkconnell et al. | |

* cited by examiner

*Primary Examiner* — Peter J Bertheaud

(57) ABSTRACT

In one embodiment, a compressor includes a motor assembly configured to compress a gas within a compression volume, the motor assembly including: a stationary coil assembly; a moving assembly having at least one magnet, and a gap located between the stationary coil assembly and the moving assembly; wherein the moving assembly is configured to reciprocate axially with respect to the stationary coil assembly when electrical current is applied to the stationary coil assembly, and to change the width of the gap between the stationary coil assembly and the moving assembly so as to provide magnetic axial stiffness against motion of the moving assembly. One or more embodiments may be used in a cryocooler assembly.

20 Claims, 6 Drawing Sheets

400

LONG LIFE SEAL AND ALIGNMENT SYSTEM FOR SMALL CRYOCOOLERS

GOVERNMENT RIGHTS

This invention was made with Government support under the Virtual AeroSurface Technologies (VAST) small-scale compressor program of the Small Business Innovative Research (SBIR) Program of the Missile Defense Agency through prime contract number W9113M-08-C-0195 (subcontract number MDA08001). The U.S. Government may have certain rights in this invention.

BACKGROUND

This application generally relates to cryocoolers, and more particularly, to a long-life seal and alignment system for small-scale cryocoolers.

Large-scale compressors typically use non-contacting clearance gap seals to prevent gas leakage. These seals include flexures that are fairly compliant in the axis of motion but extremely stiff in the cross-axes. The resistance to cross-axis motion is essential to keeping the moving elements centered in the clearance gap seals and preventing rubbing and excessive seal blow-by.

However, typical large-scale, long-life cryocooler suspension and seal systems are not readily adaptable to small-scale compressors.

Thus, an improved small-scale cryocooler suspension and seal system is desired.

SUMMARY

In an embodiment, a compressor comprises a moving assembly configured to compress a gas within a compression volume; a guide rod connected to the moving assembly which reciprocates axially with the moving assembly; and a bellows seal positioned between the moving assembly at least partially defining the compression volume.

In another embodiment, a compressor comprises: a motor assembly configured to compress a gas within a compression volume, the motor assembly including: a stationary coil assembly; a moving assembly having at least one magnet, and a gap located between the stationary coil assembly and the moving assembly; wherein the moving assembly is configured to reciprocate axially with respect to the stationary coil assembly when electrical current is applied to the stationary coil assembly, and to change the effective length of the gap between the stationary coil assembly and the moving assembly so as to provide magnetic axial stiffness resisting motion of the moving assembly.

One or more embodiments may be incorporated into a cryocooler having an expander module.

These and other aspects of this disclosure, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not a limitation of the invention. In addition, it should be appreciated that structural features shown or described in any one embodiment herein can be used in other embodiments as well.

DETAILED DESCRIPTION

Figure 1:
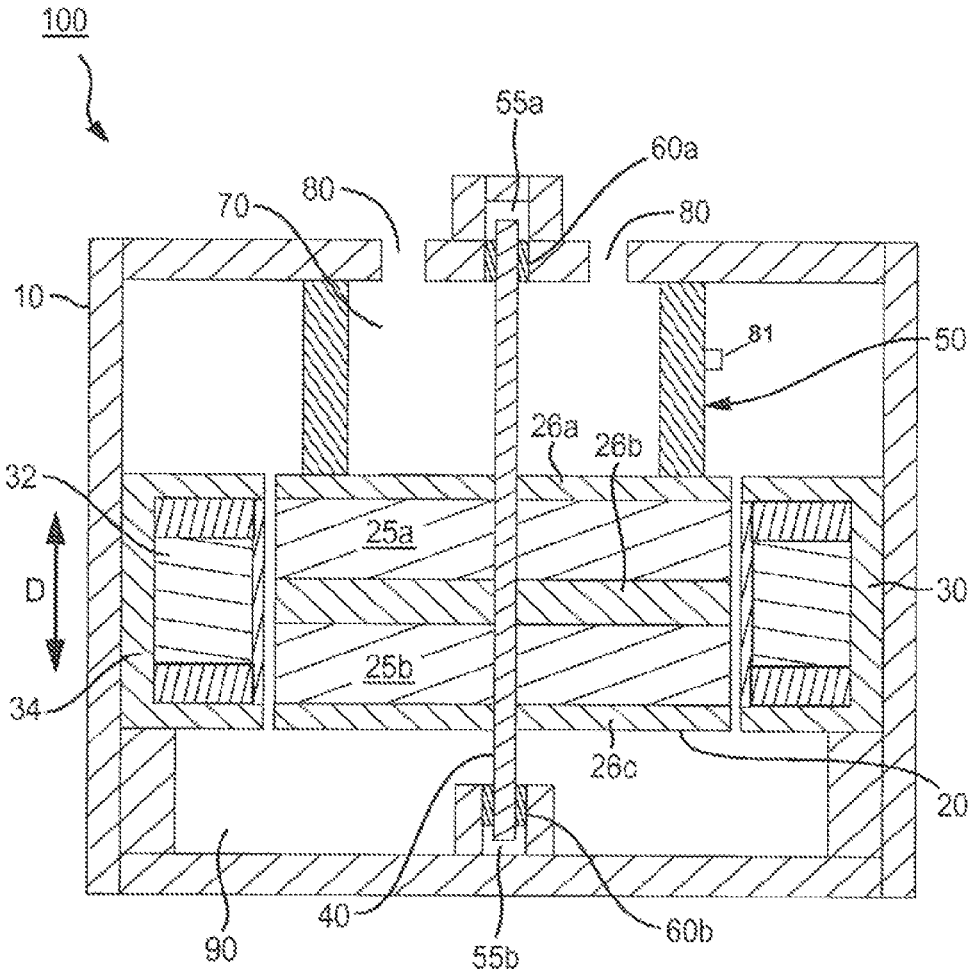
FIG. 1 shows a schematic of an exemplary small-scale compressor in accordance with an embodiment.

Small-scale cryocooler compressors are being developed under the U.S. Government's Small Business Innovative Research (SBIR) program "Small Scale Cryogenic Refrigeration Technology: Small Scale Compressor." These compressors are intended to be extremely reliable, ideally with operational lifetimes exceeding 20,000 hours. Premature compressor degradation not only reduces thermodynamic performance due to increased friction and seal blow-by, but also generates particulate debris that can further degrade performance in both the compressor and mating expander modules.

Operating frequencies of several hundred Hertz may be required in order to efficiently meet the power density goals for many small-scale compressors. The spring constant required to obtain a similarly high resonant frequency (required to maintain overall efficiency) is significantly high, and in many cases cannot be accomplished in a small-scale package through the use of mechanical springs, flexures or pneumatic forces. As such, implementation of a typical (for large-scale machines) clearance gap seal and flexure system in small-scale compressors has been problematic for several reasons.

First, large-scale flexures may not easily be scaled down to smaller sizes due to the numerous fasteners and alignment features. Previous experience with large-scale flexures has shown that proper alignment and fastening of the stacked elements are essential to limiting internal stresses (and hence preserving the long-life design) and minimizing exported disturbance in the off-axes.

Second, for proper clearance, the seals often include a mechanism for centering the moving element in the seal while locking down the flexure assemblies. However, these self-centering features are not amenable to small-scale compressors due to the lack of package volume as well as the lack of flexure fasteners.

Third, the amount of blow-by that occurs when clearance gap seals are employed in small-scale compressors is significant. In a large-scale compressor the total blow-by area presented by the clearance gap is designed to be a very small fraction of the actual piston area. The seals are designed to be physically long such that blow-by gas faces flow resistance once it enters the clearance gap. These considerations prevent significant amounts of gas from flowing through the seal during cooler operation. A similarly-sized clearance seal, implemented in a small-scale compressor, however, is not able to prevent relatively large amounts of gas from blowing by the seal. The primary reason for this is due to the fact that the seal blow-by area does not scale down as compared to the compressor piston area. Reducing the seal blow-by area to appropriate levels (by reducing the clearance gaps) requires fabrication tolerances that are very difficult, if not impossible, to achieve. The length of the seal is also necessarily smaller when implemented in a small-scale system, further lowering the seal's resistance to blow-by gas flow.

According to an embodiment, a small-scale compressor motor uses one or more magnets to provide very high levels of axial stiffness, and/or provides an improved seal arrangement. Stiff mechanical springs may no longer be necessary or required, thus eliminating packaging issues and simplifying the overall construction.

As used herein, a "small-scale compressor" means a compressor having a entire package volume in the range of 15 cubic centimeters (cc) or less.

FIG. 1 shows a schematic of small-scale compressor 100 in accordance with an embodiment.

Compressor 100 may be configured to receive electrical input power and convert it to mechanical power that may be usable by an expander module (not shown) of a cryocooler. For instance, compressor 100 may be configured for use in a linear cryocooler system such as described in U.S. Pat. Nos. 7,062,922; 6167,707 and 6,330,800, herein incorporated by reference. Of course, compressor 100 might also be used in other devices which require compressed air or gas.

Compressor 100 generally includes housing 10, moving assembly 20, motor 30, guide rod 40, bearing surfaces 60 and seal 50. As shown, compressor 100 includes a motor assembly having moving assembly 20 positioned within a central opening of stationary coil assembly 30. Moving assembly 20 includes magnets 25*a*, 25*b* positioned between plates 26*a*, 26*b*, 26*c*. Two magnets 25*a*, 25*b* are shown in moving assembly 20 with opposed polarity (e.g., N-S and S-N). However, one magnet or more than two magnets could also be used.

Stationary coil assembly 30 includes one or more motor drive coils 32 and backiron 34. When electrical current is supplied to motor drive coils 32 of stationary coil assembly 30, an electromagnetic motor force is generated tending to displace moving assembly 20 axially in axial direction D. Drive coils 32 may be formed, for instance, of metal wire wrapped radially about the stationary coil assembly 30 in an annular fashion. Plates 26*a*, 26*c*, 26*c* of moving assembly 20 and backiron 34 of stationary coil assembly 30 may be formed of a magnetic permeable metal, such as, for example, iron or magnetic steel.

Each of magnets 25*a*, 25*b* in moving assembly 20 produces a loop of magnetic flux that travels from the north poles (N) to the south poles (S) of the magnets 25*a*, 25*b* through the stationary coil assembly 30. When current is supplied to drive coils 32 the current and magnetic flux interact, causing moving assembly 20 to move axially in direction D with respect to stationary coil assembly 30. Regulating the current to drive coils 32 causes moving assembly 20 to reciprocate back and forth with respect to the stationary coil assembly 30. For instance, alternating current (AC) may be applied to the drive coils 32 for this purpose. Movement of the moving assembly 20 is shown in more detail in FIGS. 2 and 3, and discussed below.

Moving assembly 20 may be thought of as a piston axially displacing upward and downward with respect to the stationary coil assembly 30 in housing 10. Guide rod 40 may be integrated into moving assembly 20 and oriented along the axis of motion such that guide rod 40 moves with moving assembly 20 in direction D. In some implementations, guide rod 40 may be press-fit or interference-fit into a central bore of moving assembly 20.

Bearings 60*a*, 60*b* may be fixed to housing 10 on each side of moving assembly 20 such that guide rod 40 slides within bearings 60*a*, 60*b* during axial motion. Displacement zones 55*a*, 55*b* near bearing 60*a*, 60*b* may be provided to accommodate axial motion of the guide rod 40.

Guide rod 40 presses orthogonally against the bearing surfaces, and may be under slight pre-load. In this way, compressor 100 may allow movement of moving assembly 20 along the drive axis in direction D only while substantially preventing movement in off-axis directions.

In alternative implementations, moving assembly 20 could also include bearings 60*a*, 60*b* and slide axially upon one or more guide rods 40 that are fixed with respect to the housing. If there are multiple guide rods 40 they may be arranged equidistant from the center axis of compressor 100 (for instance, in a radial pattern) to reduce off-axis forces due to misalignment.

Guide rod 40 may be formed of a hard metal (for example, tungsten carbide), though other extremely hard substances such as ceramics might also be employed. Bearing surfaces 60*a*, 60*b* may be formed of a similarly hard substance and may be highly polished in order to reduce sliding friction during operation in the presence of significant side-load forces. For instance, bearing surfaces 60*a*, 60*b* may include, jewel bearings such as those typically found in high-quality clock mechanisms.

Seal 50 is interposed between the top surface of moving assembly 20 and the top inside surface of housing 10, forming a seal between the top surface of housing 10 and moving assembly 20, and forming compression space gas volume 70 having one or more outlet ports 80. As moving assembly 20 reciprocates, gas may be compressed in compression space gas volume 70 and transported via transfer line outlet port(s) 80, for instance, to an expander module (not shown) of a cryocooler (or other assembly).

In one implementation, seal 50 may be a bellows seal to seal compression space gas volume 70 from the plenum space gas volume 90 within housing 10. Seal 50 may be configured for maintain a seal for essentially the life of compressor 100 under continuous actuation. Moreover, bellows seal 50 can be configured to provide an high degree of radial stiffness, and in some cases, this stiffness may be adequate to keep the moving assembly 20 properly centered in the housing such that it does not rub against stationary portion 30 during operation. Rubbing can induce unacceptable friction (reducing overall compressor efficiency) and may lead to the generation of significant amounts of debris. Additional mechanisms may also be employed to provide increased radial stiffness. The bellows seal may be formed, in some instances, by electrodepositing a suitable spring material on a mandrel to the shape of the inside of the bellows (with the mandrel later removed). Of course, the bellows may be manufactured by other methods, such as, hydro-forming, cold-rolling, welding, chemical-depositions, etc.

The connections at both ends of seal 50 may be made gas-tight, for instance, by welding and/or bonding operations, with an adhesive. This seal configuration can replace the clearance gaps that are traditionally used in large-scale machines.

Additionally, one or more ports or valves 81 may be included in seal 50 that are configured to allow the pressure inside and outside of seal 50 to equalize over relatively long period of time (compared to the period of a single cycle of compressor operation).

No external fasteners may be required for assembly. Thus, seal 50 may be amenable to implementation in very small packages. For instance, housing 10 may be less than about 1 inch in diameter. As moving assembly 20 reciprocates along the drive axis, the sides walls of seal 50 contract or expand such that the compression space volume 70 is alternatively reduced or enlarged, causing gas to shuttle in and out of transfer line outlet 80 with minimal or no leakage.

Depending on the configuration of compressor 100, seal 50 may be compressed throughout the length of the stroke of moving assembly 20. In some implementations, a spring (or perhaps another bellows) may be included on the rear side of the moving assembly 20 to counteract the non-symmetric seal 50 axial restoring force.

Figure 2:
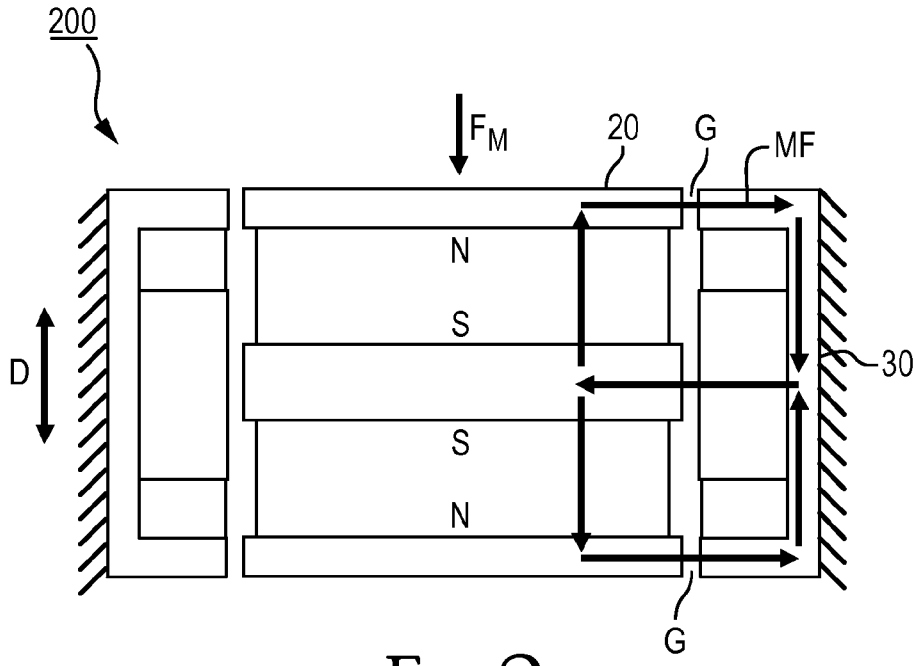
FIG. 2 shows the motor of the small-scale compressor depicted in FIG. 1 positioned at the mid-stroke position.
Figure 3:
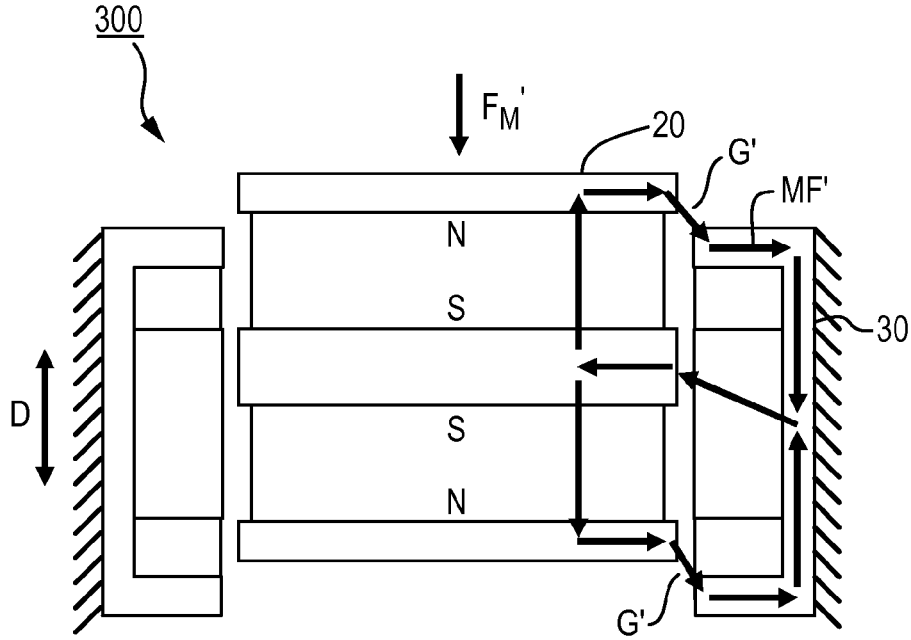
FIG. 3 shows the motor of the small-scale compressor depicted in FIG. 1 positioned at a top-stroke position.

FIGS. 2 and 3 show schematics of the operation of the motor of small scale compressor 100 depicted in depicted in FIG. 1 in accordance with an embodiment. The stoke of moving assembly 20 reciprocates axially between top-stroke and bottom-stroke positions each time passing through a mid-stoke position.

For clarity, magnetic flux MF has only been shown on the right side of the assembly, although it will be appreciated that magnetic flux MF is generated at other locations of the motor.

FIG. 2 shows the motor of compressor 100 positioned at mid-stroke position 200. In mid-stroke position 200, gaps G between the moving assembly 20 and the stationary coil assembly 30 are at a minimum and the reluctance of the magnetic circuit is minimized. As such, axial magnetic force $F_M$ acting on the moving assembly 20 is at a minimum.

FIG. 3 shows the motor of compressor 100 at top-stoke position 300, in which moving assembly 20 is furthest away from the mid-stroke position 100 at the top of its stroke. A bottom-stroke position similarly exists in which moving assembly 20 is furthest away from the mid-stroke position 100 at the bottom of its stroke.

In top-stoke position 300 (or bottom-stroke position), gaps G' between the moving assembly 20 and stationary coil assembly 30 are at a maximum and the reluctance of the magnetic circuit is maximized. This results in an increase of energy stored in magnetic flux fields MF' (compared to magnetic flux MF in mid-stoke position 200). In this state, axial magnetic restoring force $F_M'$ is at a maximum which tends to urge moving assembly 20 to return to the mid-stroke position 200 as shown in FIG. 2.

Figure 4:
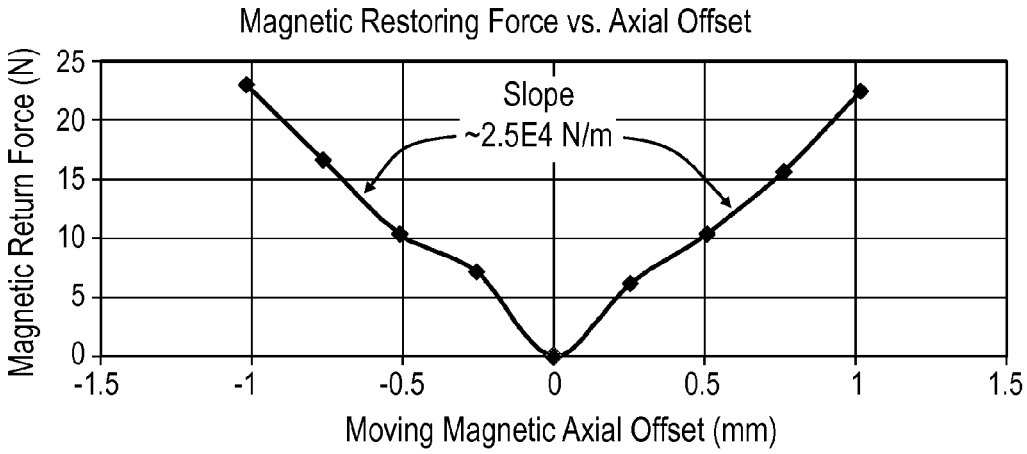
FIG. 4 shows a plot of the magnetic restoring force as a function of axial offset for a motor in accordance with an embodiment.

FIG. 4 shows plot 400 of the magnetic restoring force $F_M'$ as a function of axial offset of moving assembly 20 with respect to stationary coil assembly 30 of compressor 100. These results were obtained using a Finite Element Analysis technique.

The magnitude of axial restoring force is generally linear with the amount of moving assembly offset. As such, axial restoring force effectively acts as a magnetic spring system that may be used instead of the mechanical and gas springs typically found in large-scale compressors.

An effective spring constant for the compressor assembly may be determined, for example, by Hooke's law by dividing the magnetic restoring force device by the displacement distance. For a linear relationship, the spring constant may be the slope of line characterizing the restoring force with respect to displacement. In plot 400 shown in FIG. 4, the effective spring constant of the motor was determined to be approximately $2.5\times10^4$ N/m.

The magnetic spring associated with this sort of motor is extremely stiff given the extremely small dimensions and low moving mass. As used herein, "stiff" means an effective spring constant in excess of about 1.5E3 N/m. Given the small-scale compressor moving mass of about 10 g and a magnetic spring constant of $2.5\times10^4$ N/m, the resulting resonant frequency of the described small-scale compressor is approximately 250 Hz. For comparison, typical large-scale compressors might exhibit a stiffness in the range of $1.5\times10^4$ N/m, but in a much larger package size and with a much higher moving mass; large-scale compressors typically exhibit resonant frequencies below about 45 Hz. The described system's ability to generate extremely high levels of magnetic stiffness in a very small package volume and with a very small moving mass is novel.

Depending on the specific motor configuration, the magnetic stiffness may be made large enough to achieve the objective compressor resonant frequencies (e.g., on the order of several hundreds of hertz). This may directly enable the implementation of small-scale compressors with a high output power density. The effective spring constant of the motor assembly $K_{magentic}$ may be the tailored, for instance, by selectively adjusting one or more of the following parameters: Magnet size, number and orientation, nominal magnetic gap length, backiron size and configuration, etc.

According to various embodiments, a compressor may include one or more motors that drive one or more moving assemblies or pistons in a reciprocating or oscillating fashion. In order to minimize resistive losses in the motor drive coils (and hence maximize overall efficiency) the frequency of operation should closely match the motor resonant frequency.

The resonant frequency ω of the motor assembly may be determined according to equation (1) as follows:

$$\omega = \sqrt{\frac{K_{total}}{M_{total}}} \tag{1}$$

where:

$K_{total}$ is the total effective spring constant of the moving assembly; and $M_{total}$ is the mass of the moving assembly.

Figure 7:
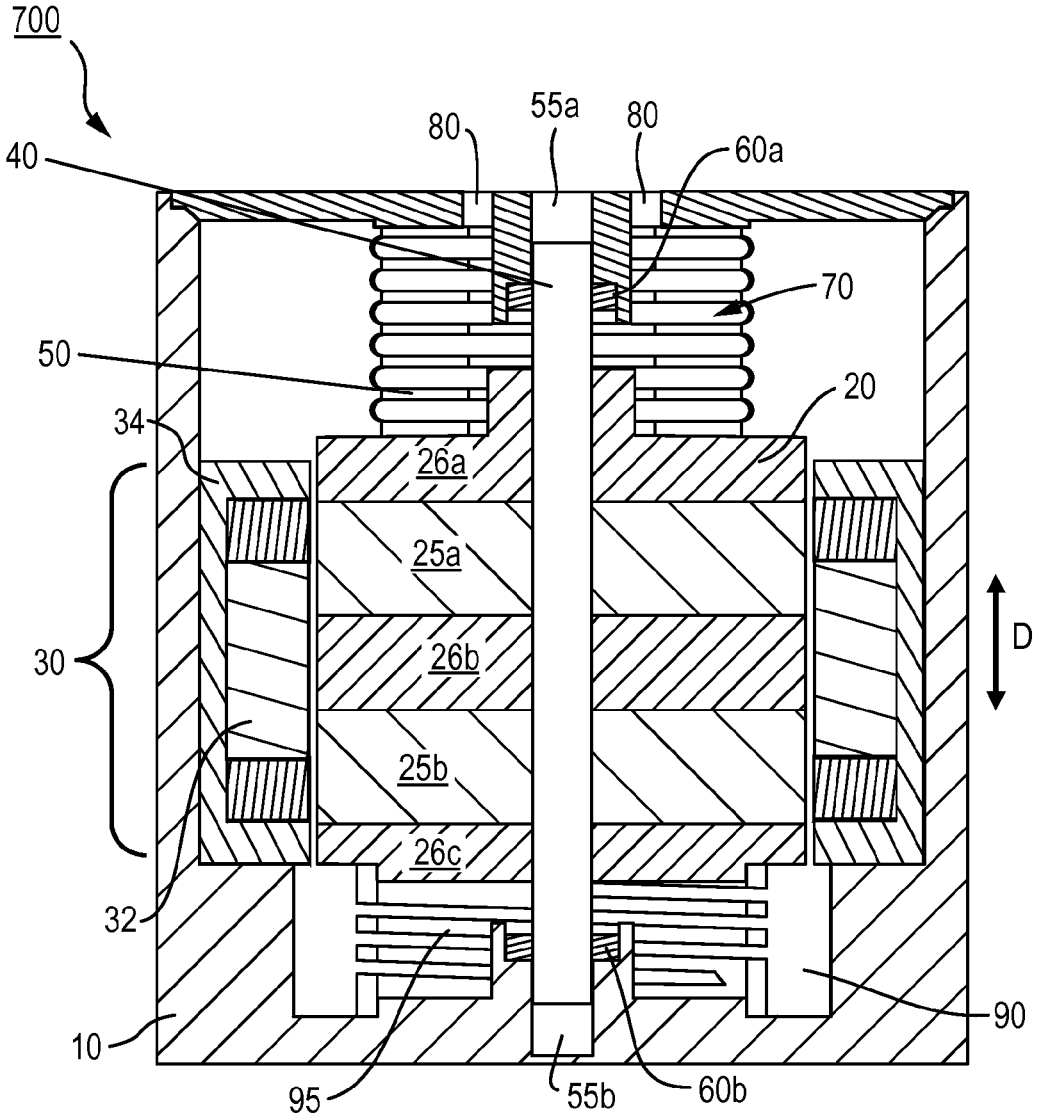
FIG. 7 show a small-scale compressor in accordance with an embodiment.

For simplicity, the moving assembly may be assumed to have a number of forces acting in parallel. These forces may include, for instance, the magnetic restoring force, the compressive force of the bellows seal, and the pressure forces acting on the moving assembly. The total effective spring constant $K_{total}$ for the compressor may be characterized according to equation (2) as the sum of various spring constants in parallel as follows:

$$K_{total}=K_{magnetic}+K_{seal}+K_{pressure} \tag{2}$$

where $K_{magentic}$ is the effective magnetic spring constant of the motor assembly of the compressor;

$K_{seal}$ is the effective bellows seal spring constant (in addition to any other mechanical springs included in the system, for instance spring 95 in FIG. 7; and $K_{pressure}$ is the effective gas spring constant of the compressive gas pressure force acting on the moving assembly.

In some instances, the bellows seal may be designed so as to have a very low effective spring constant $K_{seal}$ compared to the magnetic spring constant $K_{magentic}$ and the gas spring constant $K_{gas}$. For simplicity, bellows seal spring constant $K_{seal}$ may be assumed to be very small and might be ignored (if its contribution is small compared to the total). The effective gas constant $K_{gas}$ will be largely dictated by the gas being compressed, the compression volume, the moving assembly swept volume, the temperature, desired pressure, and/or other constraints of the cryocooler.

Compressor output power capacity can generally be increased by raising the piston stroke length, the piston area, and/or the operating frequency. Large-scale compressors may be designed to efficiently deliver high output power because the designer has greater freedom to increase the stroke length and/or piston area to the desired values that are required to deliver the power while running at the resonant frequency. Stroke length can be increased by enlarging the mechanical springs/flexures, and the piston area can be increased by simply enlarging the pistons. The output power capacity can be obtained by increasing the size of the compressor module.

However, small-scale compressors inherently preclude significant increases in piston stroke length and/or area. This may leave an increase in operating frequency as the only means to achieve the desired output power. An increase in operating frequency should be accompanied by a corresponding increase in resonant frequency in order to maintain adequate efficiency. Operating the motor significantly above or below the resonant frequency requires an increase in coil current to achieve the same stroke length, hence increasing the coil resistive losses for any given motor output power.

Figure 5:
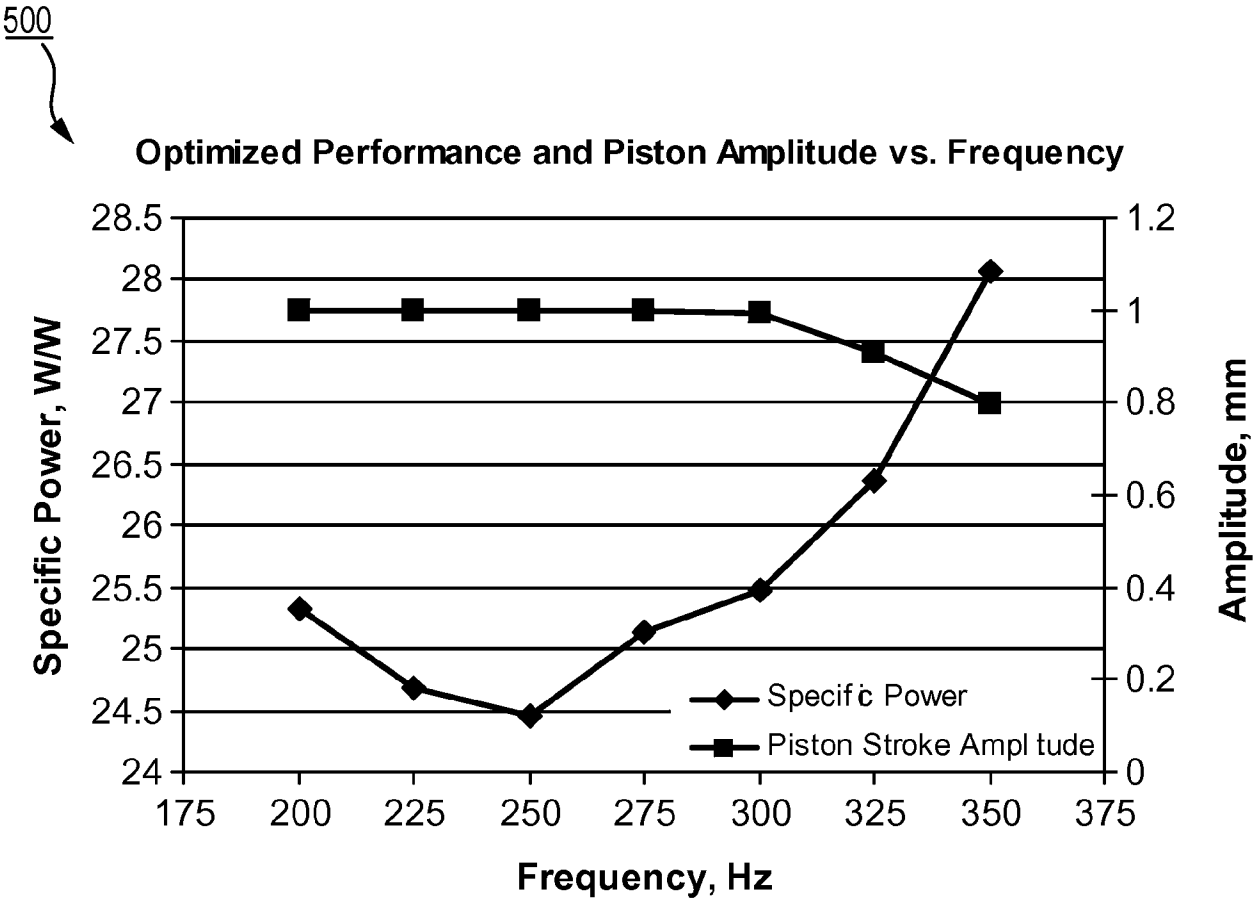
FIGS. 5 and 6 show plots of power, piston stroke amplitude and frequency for a compressor in accordance with an embodiment.
Figure 6:
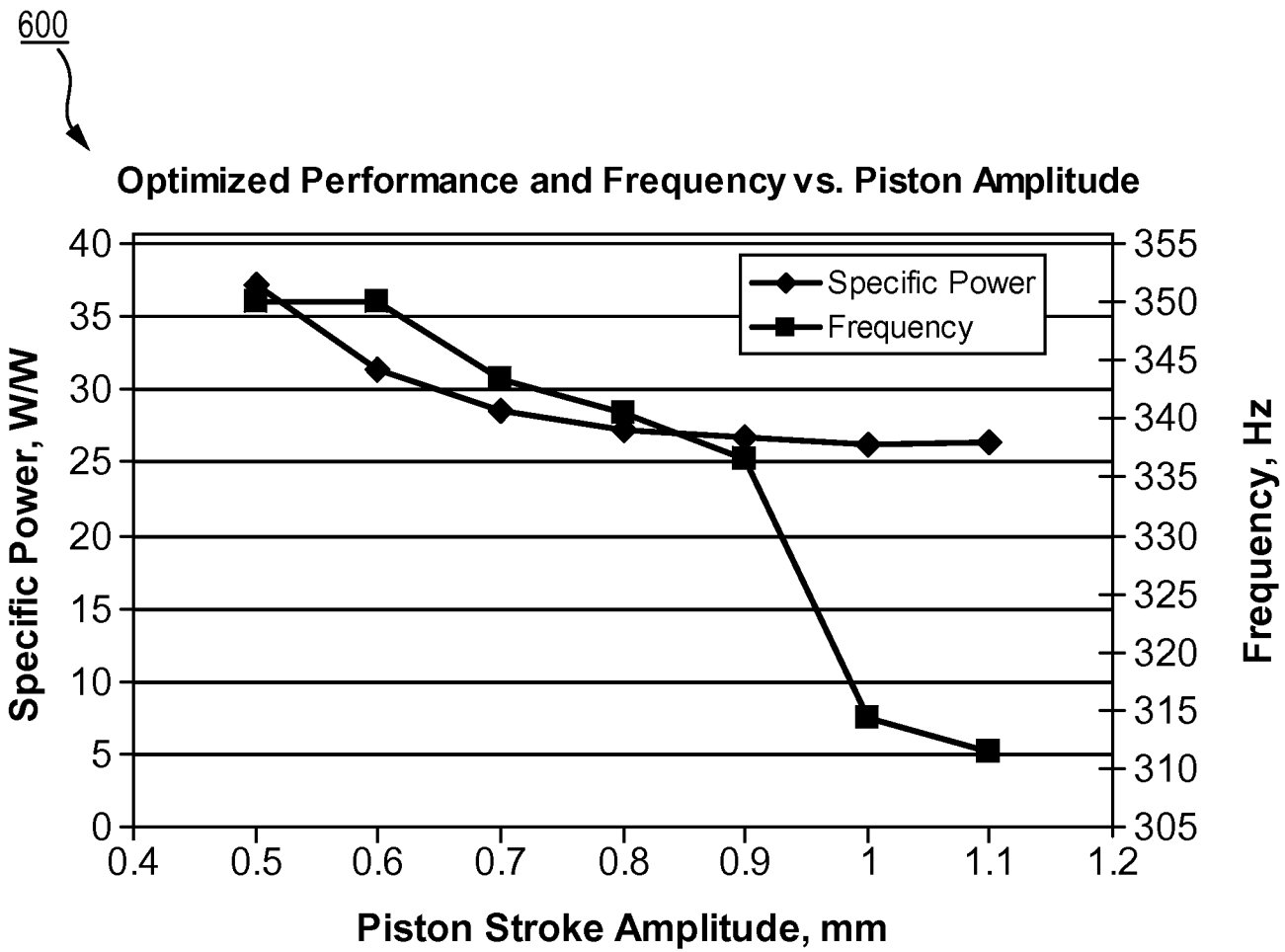

FIGS. 5 and 6 show plots 500, 600 of power, piston stroke amplitude and frequency for a compressor in accordance with an embodiment. Optimized performance of the compressor may occur at relatively low frequency and high stroke amplitude. As shown, this may occur at a frequency of about 250 Hz and a stoke of about 1 mm. A lower stroke amplitude may require higher frequency.

FIG. 7 shows small-scale compressor 700 in accordance with an embodiment.

Compressor 700 may be configured similarly to compressor 100 (FIG. 1) and generally includes housing 10, moving assembly 20, motor 30, guide rod 40, and bellows seal 50. Compressor 700 includes a motor assembly having moving assembly 20 positioned within a central opening of stationary coil assembly 30. Moving assembly 20 includes magnets 25*a*, 25*b* positioned between plates 26*a*, 26*b*, 26*c*.

Bearings 50*a*, 50*b* may be fixed to housing 10 on each side of moving assembly 20 such that guide rod 40 slides within bearings 50*a*, 50*b* during axial motion. Displacement zones 55*a*, 55*b* positioned near bearing 50*a*, 50*b* may be provided to accommodate axial motion of the guide rod 40.

Bellows seal 50 is interposed between the top surface of moving assembly 20 and the top inside surface of housing 10 form a seal between the top surface of housing 10 and moving assembly 20, and forms compression space gas volume 70 having one or more outlet ports 80. As moving assembly 20 reciprocates, gas may be compressed in compression space gas volume and shuttled via transfer line outlet port(s) 80, for instance, to an expander module (not shown) of a cryocooler (or other assembly).

In one implementation, bellows seal 50 seals compression space gas volume 70 from the plenum space gas volume 90 within housing 10. Connections at both ends of seal 60 may be made gas-tight, for instance, by welding, brazing and/or bonding operations, with an adhesive or the like. This seal configuration can replace the clearance gaps that are traditionally used in large-scale machines.

As moving assembly 20 reciprocates along the drive axis, the sides walls of seal 60 contract or expand such that the compression space volume 70 is alternatively reduced or enlarged, causing gas to shuttle in and out of transfer line outlet 80 with minimal or no leakage. Depending on the configuration of compressor 700, seal 50 may be compressed throughout the length of the stroke of moving assembly 20. In some implementations, a spring 95 may be included on the rear side of the moving assembly 20 to counteract the non-symmetric bellows axial spring force.

According to various embodiments described herein, a small scale compressor for cryocooler provides, among other things, (1) high radial stiffness; (2) effective sealing between the compressor space and plenum volumes; (3) extremely long lifetime; (4) a resonant frequency high relative to large-scale compressors and (5) ease of packaging into a very small volume.

Other embodiments, uses and advantages of the inventive concept will be apparent to those skilled in the art from consideration of the above disclosure and the following claims. The specification should be considered non-limiting and exemplary only, and the scope of the inventive concept is accordingly intended to be limited only by the scope of the following claims.

What is claimed is:

1. A compressor comprising:

a housing comprising a stationary coil assembly;

a moving assembly comprising one or more magnets and configured to compress a gas within a compression volume;

a guide rod connected to the moving assembly which reciprocates axially with the moving assembly; and a bellows seal positioned between the moving assembly and the housing, the bellows seal defining the compression volume, wherein the moving assembly is configured to reciprocally move between a top-stroke position and a bottom-stroke position while each time passing through a mid-stroke position, in which the moving assembly is in substantial alignment with the stationary coil assembly, wherein the moving assembly moves from the mid-stroke position to each respective top-stroke and bottom-stroke position due to forces generated by the stationary coil assembly, the moving assembly forming an enlarged gap between the one or more magnets and the stationary coil assembly that is larger, while in the top-stroke position and the bottom-stroke position, relative to a nominal gap formed while in the mid-stroke position, and wherein the stationary coil assembly generates a force that biases the moving assembly toward the mid-stroke position from each respective top-stroke and bottom-stroke position.

2. The compressor according to claim 1, wherein the moving assembly, the guide rod and the bellows seal are integrally formed in the housing.

3. The compressor according to claim 1, further comprising a pair of bearing surfaces, each bearing surface radially supporting the guide rod at opposite ends of the housing and permitting movement of the guide rod in the axial direction only.

4. The compressor according to claim 1, wherein the compressor has a total package volume of about 15 cubic centimeters or less.

5. The compressor according to claim 1, wherein compressed gas is transferred from the compression volume through one or more outlet ports.

6. The compressor according to claim 1, wherein the bellows seal includes a port or valve that is configured to allow the pressure inside and outside of the bellows seal to equalize over a period of time much greater than the period of a single cycle of compressor operation.

7. The compressor according to claim 1, wherein the operating frequency of the compressor is approximately several hundred hertz.

8. The compressor according to claim 1, wherein the operating frequency of the compressor is essentially equal to the resonant frequency of the compressor.

9. The compressor according to claim 1, wherein the bellows seal has a level of radial stiffness sufficient to keep the moving assembly centered in the housing such that the moving assembly does not rub against the stationary coil assembly during operation.

10. A cryocooler comprising: the compressor according to claim 1.

11. The cryocooler according to claim 10, further comprising: an expander module in communication with the compression volume.

12. A cryocooler comprising:

an expander module; and a compressor coupled to the expander module, the compressor comprising:

a housing comprising a stationary coil assembly;

a moving assembly comprising one or more magnets and configured to compress a gas within a compression volume;

a guide rod connected to the moving assembly which reciprocates axially with the moving assembly; and a bellows seal positioned between the moving assembly and the housing, the bellows seal defining the compression volume, wherein the moving assembly is configured to reciprocally move between a top-stroke position and a bottom-stroke position while each time passing through a mid-stroke position, in which the moving assembly is in substantial alignment with the stationary coil assembly, wherein the moving assembly moves from the mid-stroke position to each respective top-stroke and bottom-stroke position due to forces generated by the stationary coil assembly, the moving assembly forming an enlarged gap between the one or more magnets and the stationary coil assembly that is larger, while in the top-stroke position and the bottom-stroke position, relative to a nominal gap formed while in the mid-stroke position, and wherein the stationary coil assembly generates a force that biases the moving assembly toward the mid-stroke position from each respective top-stroke and bottom-stroke position.

13. The cryocooler according to claim 12, wherein the moving assembly, the guide rod and the bellows seal are integrally formed in the housing.

14. The cryocooler according to claim 12, further comprising a pair of bearing surfaces, each bearing surface radially supporting the guide rod at opposite ends of the housing and permitting movement of the guide rod in the axial direction only.

15. The cryocooler according to claim 12, wherein the compressor has a total package volume of about 15 cubic centimeters or less.

16. The cryocooler according to claim 12, wherein compressed gas is transferred from the compression volume through one or more outlet ports.

17. The cryocooler according to claim 12, wherein the bellows seal includes a port or valve that is configured to allow the pressure inside and outside of the bellows seal to equalize over a period of time much greater than the period of a single cycle of compressor operation.

18. The cryocooler according to claim 12, wherein the operating frequency of the compressor is approximately several hundred hertz.

19. The cryocooler according to claim 12, wherein the operating frequency of the compressor is essentially equal to the resonant frequency of the compressor.

20. The cryocooler according to claim 12, wherein the bellows seal has a level of radial stiffness sufficient to keep the moving assembly centered in the housing such that the moving assembly does not rub against the stationary coil assembly during operation.

* * * * *